US010316449B2

(12) United States Patent
Jo et al.

(10) Patent No.: US 10,316,449 B2
(45) **Date of Patent: *Jun. 11, 2019**

(54) WASHING MACHINE

(71) Applicant: LG ELECTRONICS INC., Seoul (KR)

(72) Inventors: Mingyu Jo, Seoul (KR); Seungchul Park, Seoul (KR); Dongwon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/559,620

(22) PCT Filed: Mar. 18, 2016

(86) PCT No.: PCT/KR2016/002768

§ 371 (c)(1),
(2) Date: Sep. 19, 2017

(87) PCT Pub. No.: WO2016/153232

PCT Pub. Date: Sep. 29, 2016

(65) Prior Publication Data

US 2018/0073180 A1 Mar. 15, 2018

(30) Foreign Application Priority Data

Mar. 20, 2015 (KR) ..... 10-2015-0038754

(51) Int. Cl.
*D06F 37/22* (2006.01)
*D06F 39/14* (2006.01)
(Continued)

(52) U.S. Cl.
CPC ..... *D06F 37/22* (2013.01); *D06F 37/10* (2013.01); *D06F 37/28* (2013.01); *D06F 39/14* (2013.01)

(58) Field of Classification Search
CPC ..... D06F 39/14; D06F 37/28; D06F 39/12; D06F 37/42; D06F 58/04; D06F 37/10;
(Continued)

(56) References Cited

U.S. PATENT DOCUMENTS 7,013,682 B2 * 3/2006 Sharrow ..... D06F 37/10 68/12.26
8,127,464 B2 * 3/2012 Schone ..... D06F 39/14 312/228
(Continued)

FOREIGN PATENT DOCUMENTS

JP 2006280401 10/2006
KR 10-2010-0070707 6/2010
(Continued)

OTHER PUBLICATIONS

English translation of KR1020100070707, Jun. 28, 2010.*
(Continued)

*Primary Examiner* — Hiwot E Tefera
(74) *Attorney, Agent, or Firm* — Fish & Richardson P.C.

(57) ABSTRACT

The present invention relates to a washing machine which comprises: a cabinet having a first insertion hole; a tub provided in the cabinet and having a second insertion hole aligned with the first insertion hole; a cabinet door provided to the cabinet, for opening and closing the first insertion hole; a tub door provided to the tub, for opening and closing the second insertion hole; a hinge unit for elastically supporting the tub door in the opening direction of the second insertion hole; and an antifriction member provided on one surface among the surfaces where the tub door and the cabinet door face each other, for preventing a direct friction between the tub door and the cabinet door. Accordingly, the present invention prevents the vibration and noise from the tub from being transmitted to the cabinet and may increase the capacity of the tub. In addition, when opened and closed,
(Continued)

the cabinet door for opening and closing the cabinet and the tub door for opening and closing the tub operate in association with each other, thereby being capable of giving convenience to a user.

11 Claims, 15 Drawing Sheets

(51) Int. Cl.
*D06F 37/10* (2006.01)
*D06F 37/28* (2006.01)

(58) Field of Classification Search
CPC ..... D06F 58/20; D06F 37/18; D06F 37/267; D06F 37/26; D06F 37/22; D06F 39/005
USPC ..... 312/228; 68/12.26, 196
See application file for complete search history.

(56) References Cited

U.S. PATENT DOCUMENTS

| | | | | |
|---|---|---|---|---|
| 8,661,859 | B2 * | 3/2014 | Choi | D06F 37/28 68/12.26 |
| 8,720,234 | B2 * | 5/2014 | Kim | D06F 23/025 68/3 R |
| 9,556,552 | B2 * | 1/2017 | Park | D06F 39/14 |
| 9,951,458 | B2 * | 4/2018 | Jo | D06F 37/28 |
| 9,957,656 | B2 * | 5/2018 | Jo | D06F 37/28 |
| 10,060,070 | B2 * | 8/2018 | Jo | D06F 39/14 |
| 2007/0051012 | A1 * | 3/2007 | Schoene | D06F 37/28 34/603 |
| 2011/0120195 | A1 * | 5/2011 | Jeoung | D06F 37/28 68/139 |
| 2012/0144750 | A1 * | 6/2012 | Sartor | D06F 39/14 49/399 |
| 2013/0002113 | A1 * | 1/2013 | Loss | D06F 37/28 312/291 |
| 2014/0319983 | A1 * | 10/2014 | Park | A47B 96/00 312/228 |
| 2014/0339970 | A1 * | 11/2014 | Bae | D06F 37/28 312/222 |
| 2016/0273148 | A1 * | 9/2016 | Jo | D06F 37/28 |
| 2016/0273149 | A1 * | 9/2016 | Jo | D06F 37/28 |
| 2016/0326686 | A1 * | 11/2016 | Jo | D06F 39/12 |
| 2016/0326687 | A1 * | 11/2016 | Jo | D06F 37/22 |

FOREIGN PATENT DOCUMENTS

| | | |
|---|---|---|
| KR | 10-2012-0043261 | 5/2012 |
| KR | 1020120043263 | 5/2012 |
| KR | 101221458 | 1/2013 |
| KR | 101231027 | 2/2013 |
| KR | 10-2013-0080965 | 7/2013 |

OTHER PUBLICATIONS

English translation of KR101231027 Feb. 19, 2013.*
International Search Report in International Application No. PCT/KR2016/002768, dated Jun. 1, 2016, 14 pages (with partial English translation).
European Extended Search Report in European Application No. 16769050.2, dated Nov. 19, 2018, 51 pages.

* cited by examiner

- RELATED ART -

WASHING MACHINE

CROSS-REFERENCE TO RELATED APPLICATIONS

This application is a National Stage application under 35 U.S.C. § 371 of International Application No. PCT/KR2016/002768, filed Mar. 18, 2016, which claims the benefit of Korean Application No. 10-2015-0038754, filed on Mar. 20, 2015. The disclosures of the prior applications are incorporated by reference in their entirety.

TECHNICAL FIELD

The present invention relates to a washing machine, and more particularly, to a washing machine in which a door structure is improved to prevent vibration and noise generated in a tub when the washing machine is operated from being delivered to a case of the washing machine.

BACKGROUND ART

Generally, a washing machine is an appliance that removes various contaminants attached to clothes, bedding, etc. by using an emulsification process of detergent, or friction of a water flow according to a pulsator or drum, and impact applied to laundry.

A full automatic washing machine which has been recently developed automatically performs a series of strokes such as a washing course, a rinsing course and a dehydrating course without manipulation of a user.

Also, demands of a drum type washing machine are gradually being increased, in which tangle and wrinkling of laundry little occur and a whole height is reduced as compared with a pulsator washing machine of which washing tub is rotated in a standing state.

A structure of the aforementioned drum type washing machine 10 will be described in brief with reference to the accompanying drawing.

As shown in FIG. 1, the drum type washing machine 10 includes a main body cabinet 11 forming an external appearance, a tub (not shown) arranged inside the main body cabinet 11 and supported by a damper (not shown) and a spring (not shown), in which washing water is stored, and a cylindrical drum 15 arranged inside the tub to put laundry therein, wherein a driving force is delivered to the drum 15 by a driving unit 17 for washing laundry put into the drum 15.

Such a drum type washing machine 10 according to the related art is necessarily provided with a gasket 19 between an opening of a tub 13 and the main body cabinet 11 to prevent leakage of washing water stored in the tub 13 from occurring.

Meanwhile, the washing machine 10 according to the related art necessarily causes vibration due to factors such as a rotational force of the drum 15 and eccentricity of laundry when the drum 15 is rotated to wash and dehydrate laundry put into the drum 15, wherein the vibration generated by rotation of the drum 15 is delivered to the outside through the tub 13 and the cabinet 11.

In this case, vibration and nose delivered to the tub 13 are delivered to the cabinet 11 through the gasket 19 that maintains water density between the cabinet 11 and the tub 13, whereby a problem occurs in that vibration and noise are generated in the cabinet 11.

Also, in case of the washing machine 10 according to the related art, laundry is interposed between a door 12 for closing the tub 13 and the drum 15 which is rotated. To prevent laundry from being interposed between the door and the drum, an inner side of the door 12 is protruded toward an inner side of the opening of the tub 13 or the opening of the drum 15. However, such a protrusion structure of the door 12 occupies washing capacity, whereby a problem occurs in that substantial washing capacity is deteriorated.

DISCLOSURE

Technical Problem

An object of the present invention is to provide a washing machine that improves a structure between the tub and the cabinet to prevent vibration of a tub from being delivered to a cabinet through a gasket, thereby preventing vibration and noise of the tub from being delivered to the cabinet.

Another object of the present invention is to provide a washing machine that improves an inner structure between a cabinet and a tub to increase tub capacity as compared with the related structure.

Other object of the present invention is to provide a washing machine that includes a cabinet door for opening or closing a cabinet and a tub door for opening or closing a tub to allow the cabinet door and the tub door to interwork with each other when the cabinet door and the tub door are opened or closed.

Technical Solution

To achieve these objects and other advantages and in accordance with the purpose of the invention, a washing machine according to one embodiment of the present invention comprises a cabinet having a first insertion hole; a tub provided in the cabinet, having a second insertion hole aligned with the first insertion hole; a cabinet door provided in the cabinet, opening or closing the first insertion hole; a tub door provided in the tub, opening or closing the second insertion hole; a hinge unit for elastically supporting the tub door in the opening direction of the second insertion hole; and an anti-friction member provided on one among surfaces where the tub door and the cabinet door face each other, for preventing a direct friction between the tub door and the cabinet door.

Preferably, the washing machine further comprises an unlocking unit for releasing a locking state of the tub door when the cabinet door is opened.

Preferably, the cabinet includes a cabinet door lock for maintaining a locking state of the cabinet door, and the tub includes a tub door lock for maintaining a locking state of the tub door.

Preferably, the unlocking unit includes a release lever provided in a grip portion of the cabinet door; a release switch for sensing opening of the cabinet door in accordance with an operation of the release lever; and a tub door lock releaser for releasing the tub door lock in accordance with sensing of the release switch.

Preferably, the unlocking unit includes a release lever provided in a grip portion of the cabinet door; a release switch for sensing opening of the cabinet door in accordance with an operation of the release lever; and a tub door lock for releasing the locking state of the tub door in accordance with sensing of the release switch.

Preferably, the cabinet door is fixed to the hinge unit to have a rotational shaft to be spaced apart from the hinge unit.

Preferably, the cabinet door is opened by interworking with the tub door as the tub door is opened.

Preferably, the anti-friction member pressurizes the cabinet door to open the first insertion hole as the tub door is opened.

Preferably, the tub door is closed by interworking with the cabinet door as the cabinet door is closed.

Preferably, the cabinet door pressurizes the anti-friction member to close the first insertion hole as the cabinet door is closed.

Preferably, the anti-friction member includes a pressurizing roller provided at an outer side of the tub door to pressurize the cabinet door to be adjacent to an inner side of the cabinet door.

Preferably, the tub includes a tub door lock for maintaining the locking state of the tub door, and the tub door lock switches the tub door to a locking state as the cabinet door is rotated in a closing direction.

Preferably, the cabinet includes a cabinet door lock for maintaining the locking state of the cabinet door, and the tub door lock switches the tub door to a locking state after the cabinet door is switched to the locking state by the cabinet door lock.

Preferably, the cabinet door lock moves the cabinet door to be spaced apart from the tub door after the tub door is switched to the locking state.

Advantageous Effects

According to the washing machine of the present invention, a structure between a tub and a cabinet is improved to prevent vibration and noise of the tub from being delivered to the cabinet, whereby vibration and noise generated in the cabinet may be reduced, and thus unpleasant vibration and nose may be prevented from being delivered to a user.

Also, according to the washing machine of the present invention, it is possible to increase tub capacity by improving the structure between the tub and the cabinet.

Also, according to the washing machine of the present invention, a cabinet door for opening or closing a cabinet and a tub door for opening or closing a tub may interwork with each other when the cabinet door and the tub door are opened or closed, whereby convenience may be provided to a user.

BEST MODE FOR CARRYING OUT THE INVENTION

Hereinafter, a washing machine according to one embodiment of the present invention will be described with reference to the accompanying drawings.

Titles of respective elements are defined in description of the present invention in consideration of their functions in the present invention and therefore it is not to be understood that the titles restrict technical elements of the present invention. Also, the titles defined in the respective elements may be referred to as other titles.

Figure 1:
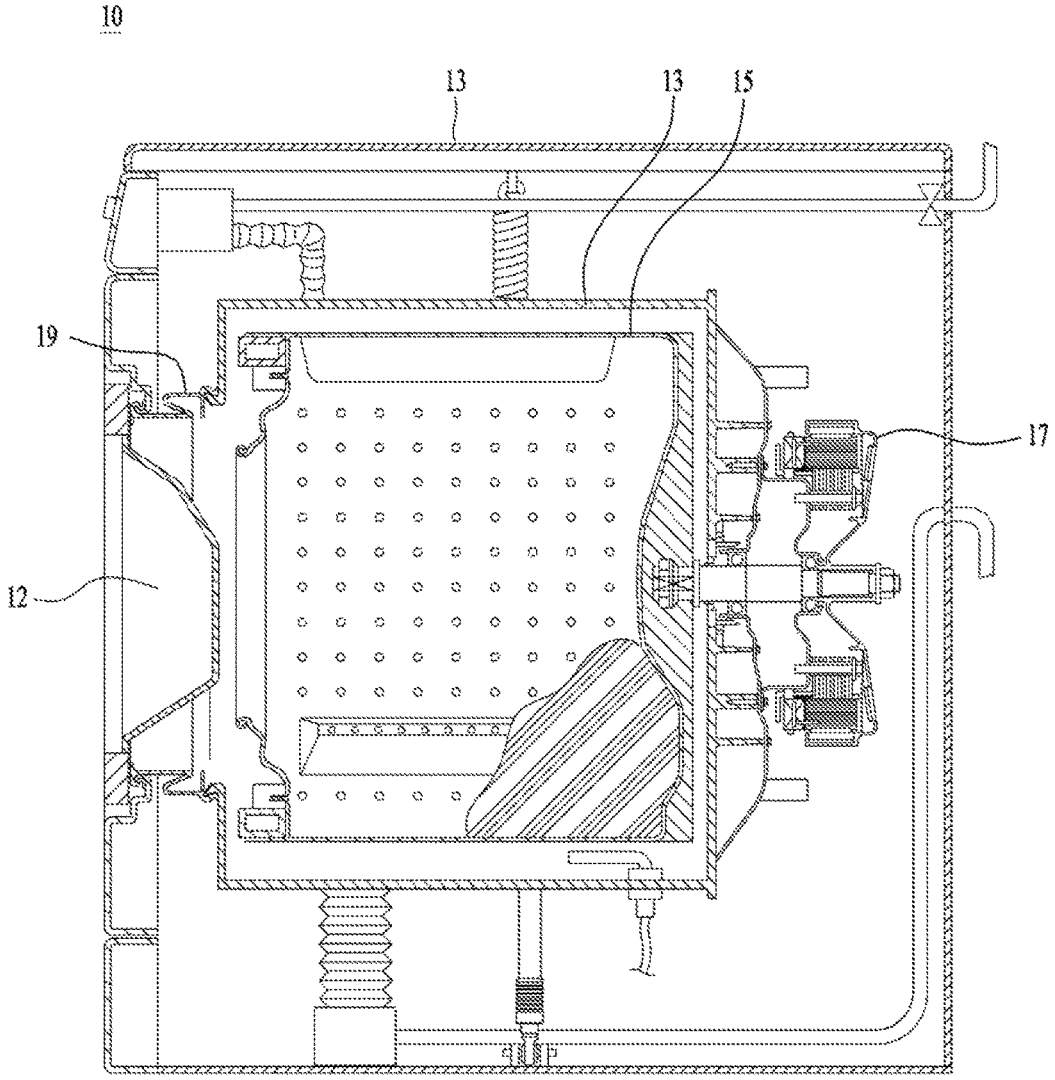
FIG. 1 is a brief view illustrating a washing machine according to the related art.
Figure 2:
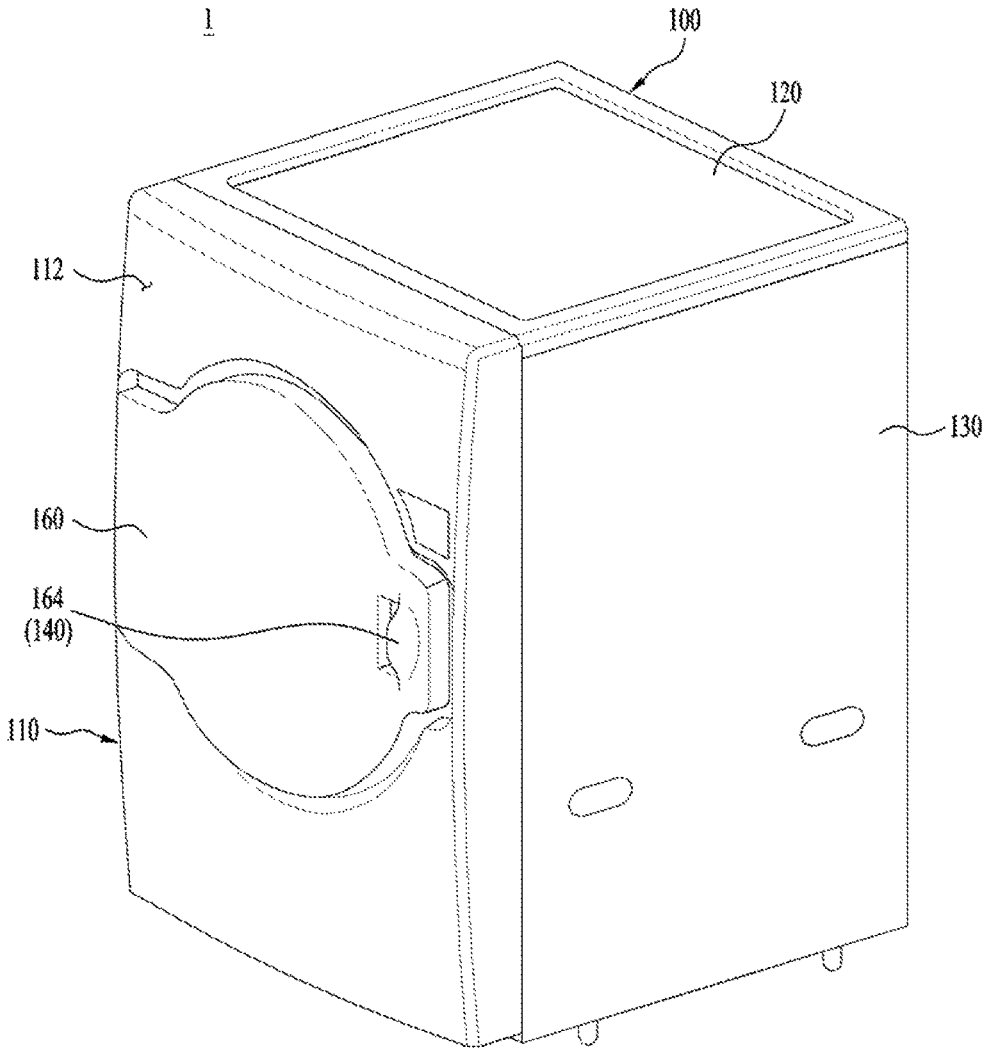
FIG. 2 is a perspective view illustrating a washing machine according to the present invention.
Figure 3:
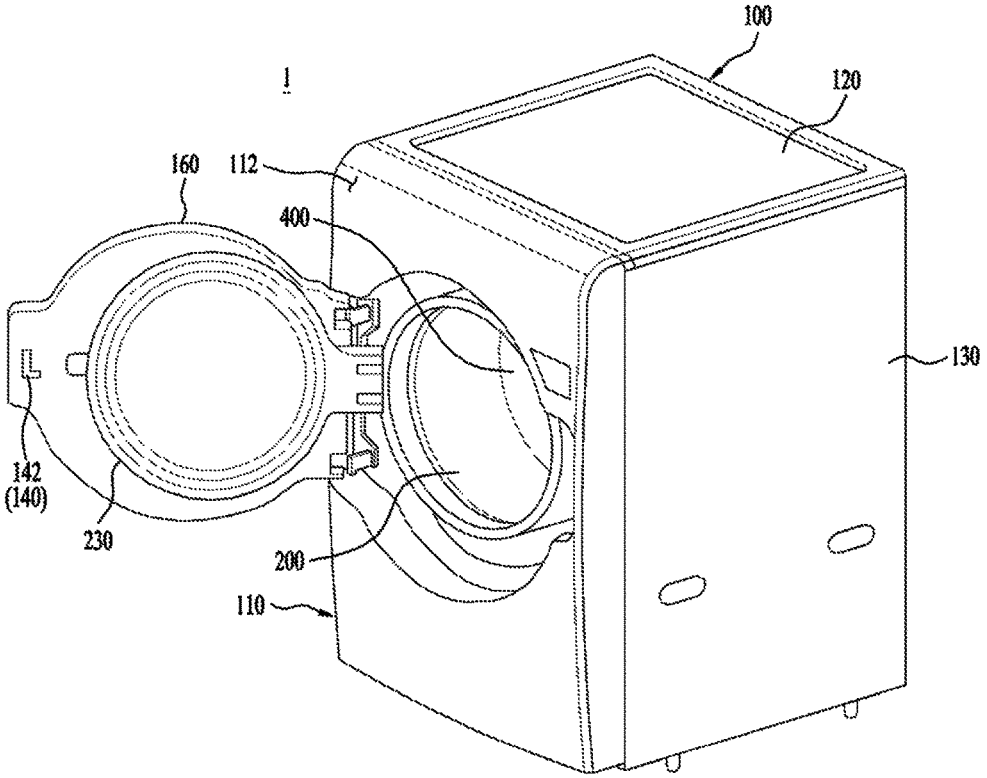
FIG. 3 is a perspective view illustrating the state that each door of a washing machine according to the present invention is opened.

First of all, a washing machine according to one embodiment of the present invention will be described in brief with reference to the accompanying drawings. FIG. 2 is a perspective view illustrating a washing machine according to the present invention. FIG. 3 is a perspective view illustrating the state that each door of a washing machine according to the present invention is opened.

As shown in FIGS. 2 and 3, the washing machine 1 according to one embodiment of the present invention comprises a cabinet 100 for forming an external appearance, a tub 200 supported by a suspension (not shown) such as a damper and spring inside the cabinet, in which washing water is stored, a drum 400 rotatably provided inside the tub 200 to allow laundry to be loaded therein, and a driving unit (not shown) for rotating the drum.

The cabinet 100 may include a front cabinet 110 for forming the front of the washing machine, a horizontal cabinet 130 for forming left and right sides of the washing machine, and an upper cabinet 120 for forming a top surface of the washing machine.

A first insertion hole 114 for allowing laundry to put in a loading space of the drum 400 is formed at the center of the front cabinet 110, and is provided with a cabinet door 160 for opening or closing the first insertion hole 114.

A control panel 112 that includes a manipulation unit and a display unit for controlling and displaying an overall operation of the washing machine 1 may be provided on a top portion of the first insertion hole 114.

A second insertion hole 210 opened to allow laundry put in the first insertion hole 114 to be loaded in the drum 400 is formed at the front of the tub 200, and includes a tub door 230 for opening or closing the second insertion hole 210.

The present invention relates to a cabinet door 160 and a tub door 230, and description of the other elements (for example, drum, suspension, water supply unit, drainage unit, etc.) will be omitted.

Figure 4:
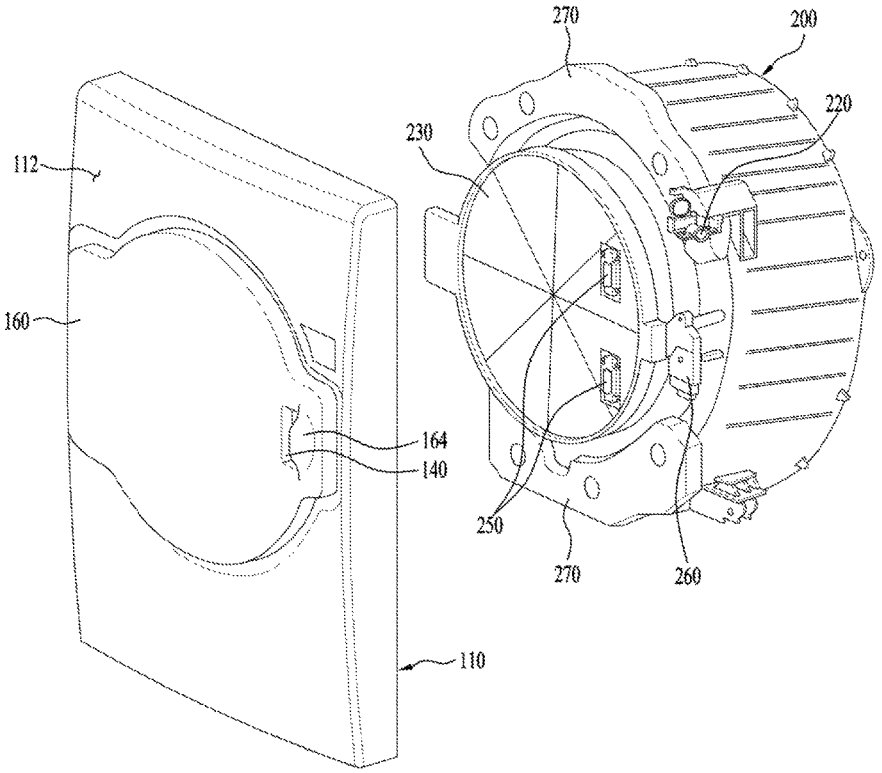
FIG. 4 is a perspective view illustrating an arrangement state of a cabinet door and a tub door which are main parts of a washing machine according to the present invention.

Hereinafter, the front cabinet and the tub which are main parts of the present invention will be described in detail with reference to FIGS. 4 and 5. FIG. 4 is a perspective view illustrating an arrangement state of a cabinet door and a tub door which are main parts of a washing machine according to the present invention, and FIG. 5 is an exploded perspective view illustrating an arrangement state of a cabinet door and a tub door which are main parts of a washing machine according to the present invention.

Figure 5:
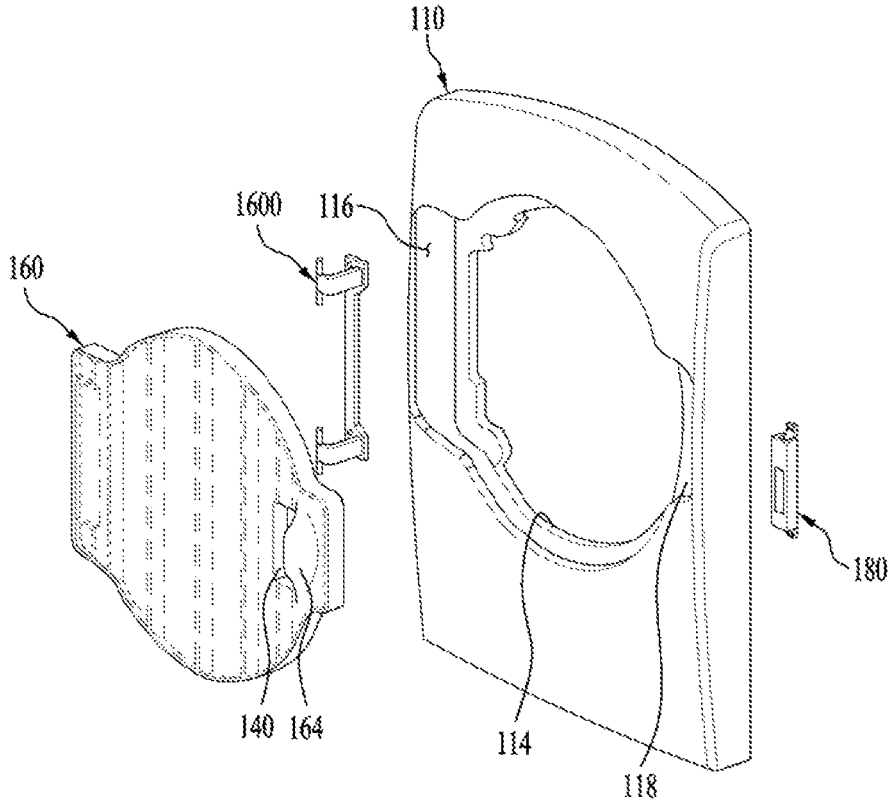
FIG. 5 is an exploded perspective view illustrating an arrangement state of a cabinet door and a tub door which are main parts of a washing machine according to the present invention.

As shown in FIGS. 4 and 5, a cabinet hinge coupling unit 116 to which the cabinet door 160 is rotatably hinge-coupled is formed to be recessed at one side of the first insertion hole 114 formed in the front cabinet 110, and a cabinet door lock coupling unit 118 for setting a locking state of the cabinet door 160 is formed at the other side of the cabinet hinge coupling unit 116.

A cabinet door lock 180 is provided inside the cabinet door lock coupling unit 118 so as not to be exposed to the outside of the front cabinet 110. Also, a grip portion 164 for opening the cabinet door 160 is formed at the other side of the cabinet door 160.

An unlocking unit 140 for locking or unlocking the cabinet door 160 and the tub door 230 is provided inside the grip portion 164. The unlocking unit 140 is provided to simultaneously unlock the cabinet door lock 180 which locks the cabinet door 160 and the tub door lock 260 which locks the tub door 230 by a single operation of a user. The unlocking unit 140 will be described together with the cabinet door 160.

Figure 6:
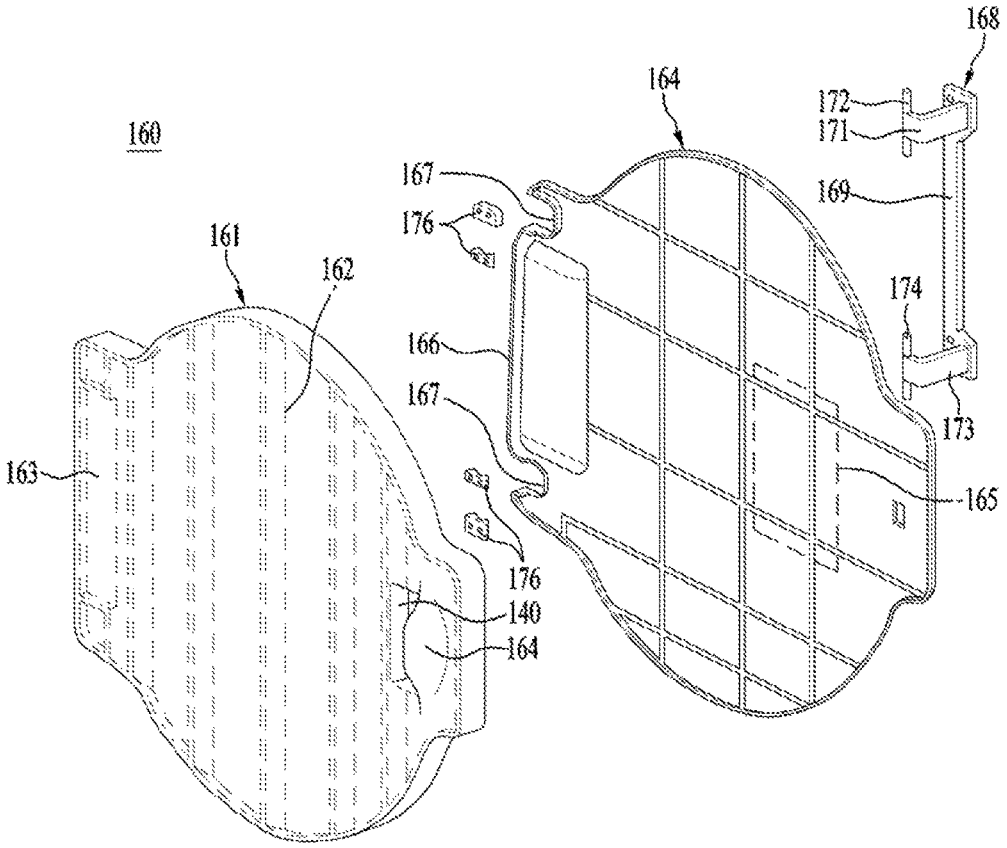
FIG. 6 is a detailed exploded perspective view illustrating a cabinet door of a washing machine according to the present invention.

The cabinet door 160 is rotatably provided in the first insertion hole 114 of the front cabinet 110 to open or close the first insertion hole 141 as shown in FIG. 6, and includes a first outer frame 161 forming an outer side of the cabinet door 160, a first inner frame 164 forming an inner side of the cabinet door 160, and a first hinge unit 168 rotatably supporting the cabinet door 160.

The first outer frame 161 and the first inner frame 164 are coupled to each other by a coupling member (not shown) such as a bolt, and may be formed of a transparent material to allow a user to identify an inner operation state of the washing machine 1.

Meanwhile, an outer side (that is, outer side of the first outer frame 161) of the cabinet door 160 is preferably formed on an extension surface of the front cabinet 110 along an external appearance of the front cabinet 110, and the grip portion 164 for opening the cabinet door 160 is formed at an opposing side of the first hinge unit 168.

A plurality of reinforcing ribs 162 for reinforcing strength of the first outer frame 161 may be formed at the inner side of the first outer frame 161. A roller pressurizing surface 165 with which a pressurizing roller 250 of the tub door 230 is in contact is formed at an inner side (that is, outer side of the first inner frame 164) of the cabinet door 160. The pressurizing roller 250 will be described later.

When the cabinet door 160 is pressurized and closed by a user, the roller pressurizing surface 165 pressurizes the pressurizing roller 250 of the tub door 230, whereby the cabinet door 160 and the tub door 230 may be closed by interworking with each other.

The first hinge unit 168 provided in the cabinet hinge coupling unit 116 formed in the first insertion hole 114 to rotatably support the cabinet door 160 is provided at one side of the cabinet door 160.

The unlocking unit 140 fixed to be held in the cabinet door lock 180 when the cabinet door 160 closes the first insertion hole 114, unlocking the cabinet door lock 180 by means of an operation of a user is provided at the inner side of the grip portion 164 formed in the first outer frame 161. The unlocking unit 140 will be described together with the cabinet door lock 180.

A protrusion 163 for providing the first hinge unit 168 is formed in the first outer frame 161, and a protrusion 166 is formed at one side of the first inner frame 168 to correspond to the protrusion 163 of the first outer frame 161.

A pair of recesses 167 to which upper and lower rotational portions 171 and 173 of the first hinge unit 168 are inserted are formed at upper and lower sides of the protrusion 166 formed in the first inner frame, and a pair of brackets 176 for fixing upper and lower rotational shafts 172 and 174 of the first hinge unit 168 are respectively coupled to the pair of recesses 167. The upper and lower rotational portions 171 and 173 and the upper and low rotational shafts 172 and 174 will be described later.

The protrusion 166, the recesses 167 and the brackets 176, which are formed in the first inner frame 168, are shielded by the protrusion 163 formed in the first outer frame 161 when the first outer frame 161 and the first inner frame 168 are coupled to each other.

The first hinge unit 168 includes a hinge body 169 fixed to the cabinet hinge coupling unit 116 formed in the first insertion hole 114 of the front cabinet, the upper and lower rotational portions 171 and 173 extended from upper and lower portions of the hinge body 169, and the upper and lower rotational shafts 172 and 174 extended respectively from ends of the upper and lower rotational portions 173.

It is preferable that the upper and lower rotational portions 171 and 173 formed in the hinge body 169 of the first hinge unit 168 are formed to be spaced apart from each other at a predetermined interval. These upper and lower rotational portions 171 and 173 are spaced apart from each other at a predetermined interval to avoid a structural overlap with a second hinge unit 242 of the tub door 230, which will be described later. The second hinge unit 242 is arranged between the upper and lower rotational portions 171 and 173.

The cabinet door lock 180 which is locked by insertion of a cabinet door hook 142 of the unlocking unit 140 to the inner side of the front cabinet 110 is provided in the cabinet door lock coupling unit 118 formed at the other side of the first insertion hole 114 of the front cabinet 110.

Figure 7:
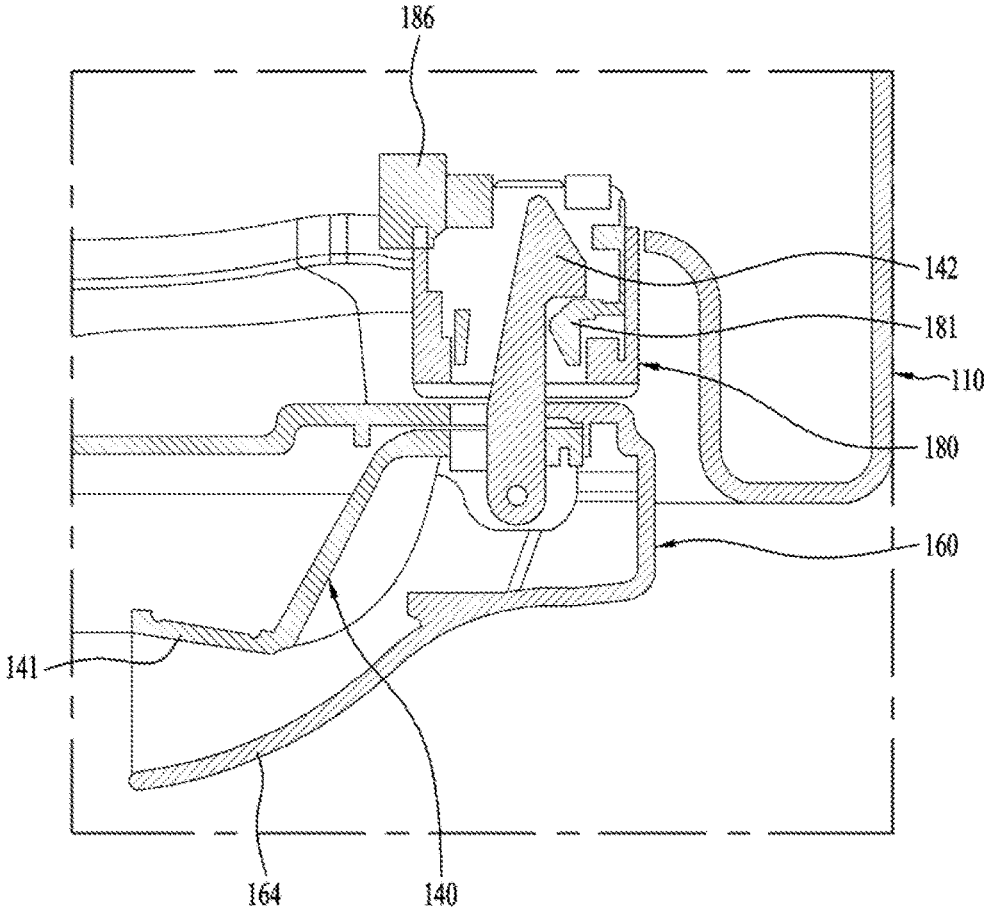
FIG. 7 is a cross-sectional view illustrating an unlocking unit of a washing machine according to the present invention.

Hereinafter, the unlocking unit 140 and the cabinet door lock 180 according to the present invention will be described with reference to FIGS. 7 and 8. FIG. 7 is a cross-sectional view illustrating an unlocking unit of a washing machine according to the present invention, and FIG. 8 is an exploded perspective view illustrating a cabinet door locking unit of a washing machine according to the present invention.

As shown in FIG. 7, the unlocking unit 140 is located inside the grip portion 164 to unlock the cabinet door lock 180 by pressurization of a user when the user grips the grip portion 164 to open the cabinet door 142.

The unlocking unit 140 includes a locking release lever 141, a cabinet door hook 142 fixed by the cabinet door lock 160 when the first insertion hole 114 of the cabinet door 160 is closed and released from the cabinet door lock 180 when the release lever 141 is pressurized, and a pressurizing spring 143 exerting an elastic force to always fix the cabinet door hook 142 to the cabinet door lock 180.

Figure 8:
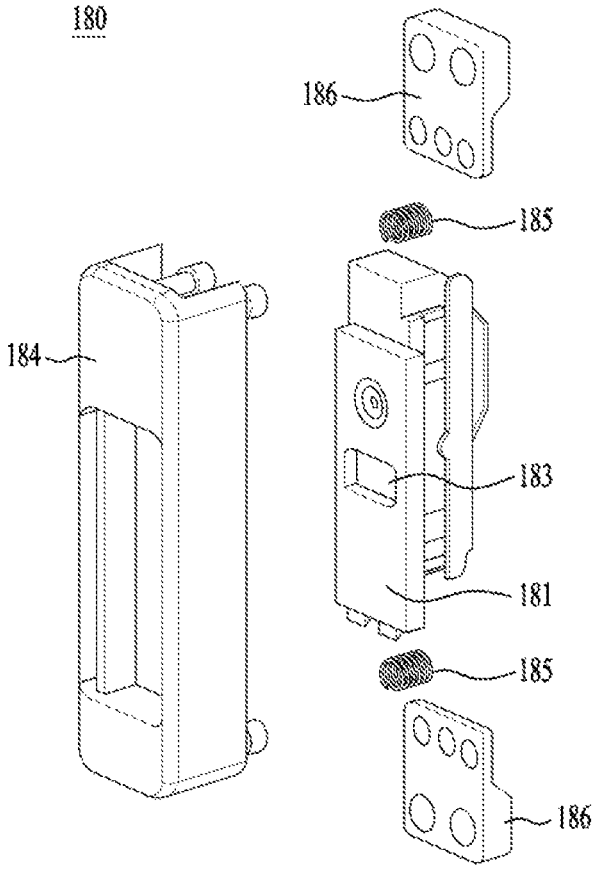
FIG. 8 is an exploded perspective view illustrating a cabinet door locking unit of a washing machine according to the present invention.

The cabinet door lock 180 is intended to control the locking state of the cabinet door 160 provided in the first insertion hole 114 as shown in FIGS. 7 and 8, and includes a hook holder 181 fixed into the cabinet door lock coupling unit 118 of the front cabinet 110, a hook insertion unit 183 movably fixed to the hook holder 181 in an insertion direction of the cabinet door hook 142 outside the cabinet door lock coupling unit 118, an elastic support unit 184 elastically supporting the hook insertion unit 183 in an opposite direction of the insertion direction of the cabinet door hook 142 by means of an elastic body such as spring, and an unlocking switch 143 for sensing an operation of the cabinet door hook 142 when a locking state of the cabinet door hook 142 fixed to the hook holder 181 is released. The unlocking switch 143 generates an electric signal for an operation of a tub door releaser 220 which will be described later.

The cabinet door lock 180 further has a spare moving space where the hook insertion unit 183 is elastically supported by the elastic support unit 184 after the cabinet door hook 142 is fixed by the hook holder 181 when the cabinet door 160 is closed. By the spare moving space, the cabinet door 160 further pressurizes the tub door 230 after being fixed to the hook holder 181 of the cabinet door lock 180 to close the tub door 230. An interworking configuration of the cabinet door 160 and the tub door 230 will be described in detail when the operation of the cabinet door 160 and the tub door 230 is described.

Figure 9:
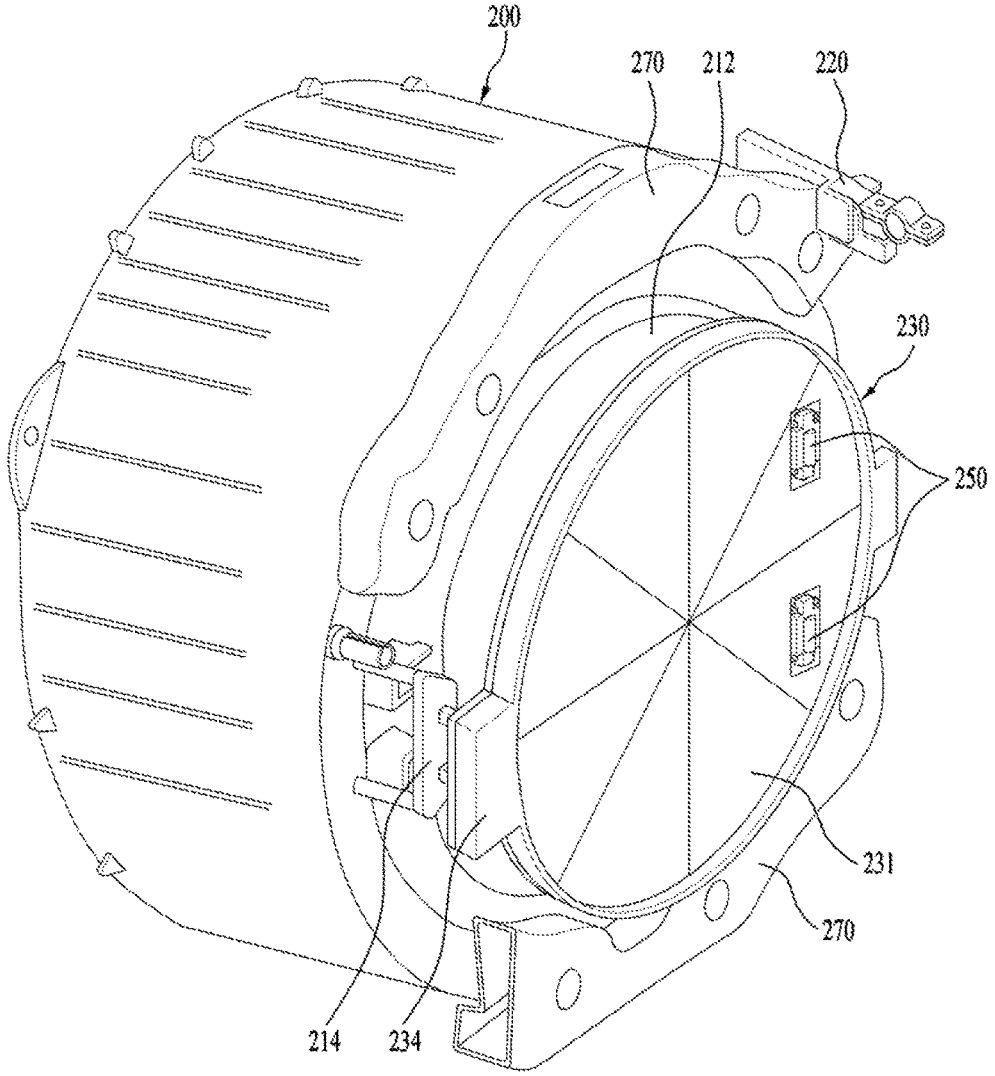
FIG. 9 is a perspective view illustrating a tub and a tub door of a washing machine according to the present invention.

Hereinafter, the tub door will be described in detail with reference to FIGS. 9 and 10. FIG. 9 is a perspective view illustrating a tub and a tub door of a washing machine according to the present invention, and FIG. 10 is an exploded perspective view illustrating a tub door of a washing machine according to the present invention.

Figure 10:
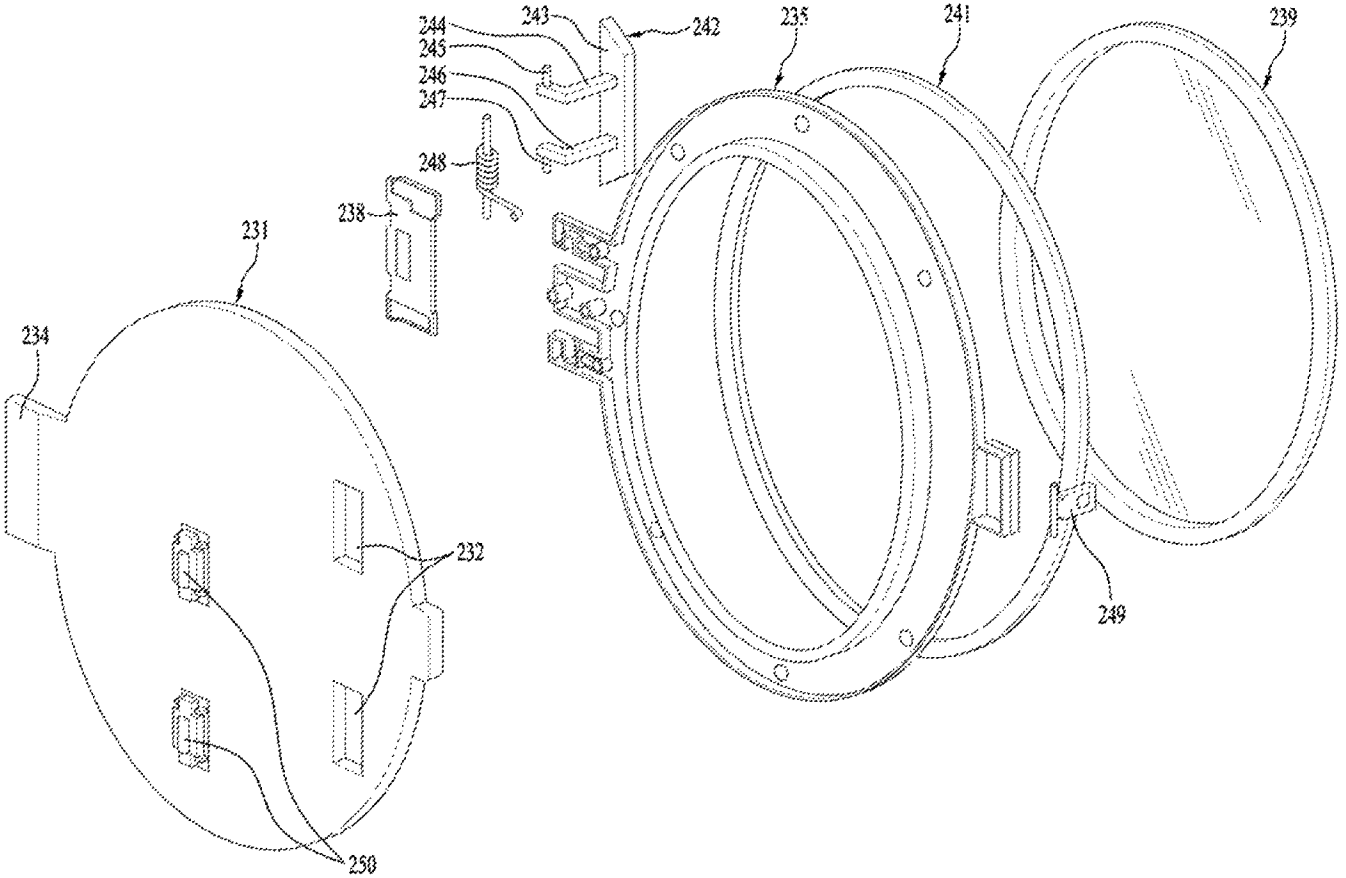
FIG. 10 is an exploded perspective view illustrating a tub door of a washing machine according to the present invention.
Figure 11:
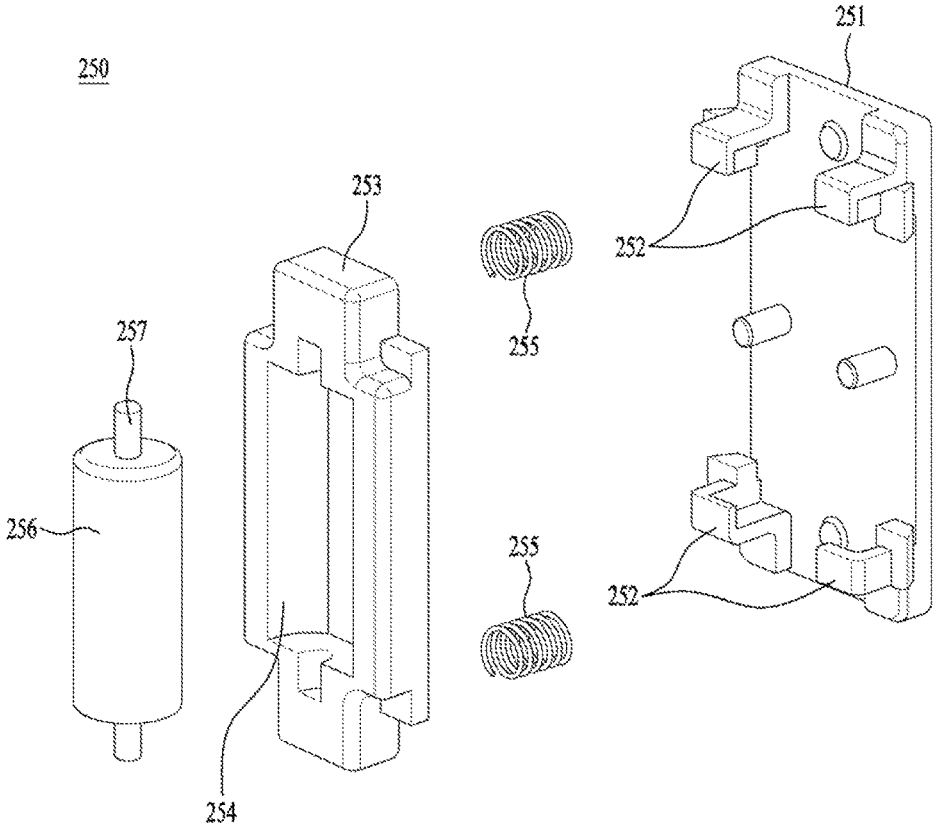
FIG. 11 is an exploded perspective view illustrating a pressurizing roller of a tub door of a washing machine according to the present invention.

As shown in FIGS. 9 and 10, a second insertion hole 210 for loading of laundry is formed at the front of the tub 200 to be extended from the first insertion hole 114 in a state that it is spaced apart from the first insertion hole 114 of the cabinet 100. A weight balancer 270 for preventing vibration of the tub 200 from occurring by increasing mass of the tub 200 is provided outside the second insertion hole 210, and the tub door 230 spaced apart from the cabinet 100 to open or close the second insertion hole 210 of the tub 200 is provided at one side of the second insertion hole 210 formed at the front of the tub 200.

The second insertion hole 210 formed at the front of the tub 200 is provided with a ring shaped rim portion 212 provided toward the front cabinet 110, and a second hinge coupling unit 214 provided with a second hinge unit 242, which will be described later, is formed to be protruded at one side of the rim portion 212, and a tub door lock coupling unit 216 provided with the tub door lock 260 for setting the locking state of the tub door 230 for opening or closing the second insertion hole 210 is provided at the other side of the rim portion 212.

The second hinge unit 242 for allowing the tub door 230 to open or close the second insertion hole 210 by rotatably supporting the tub door 230 is provided at one side of the front of the tub 200, and the tub door lock 260 for setting the locking state of the tub door 230 is provided at the other side of the front of the tub 200. Also, the tub door lock releaser 220 for releasing the locking state of the tub door lock 260 is provided at an upper portion of the tub door lock 260.

The aforementioned tub door 230, tub door lock 260 and tub door lock releaser 220 are not connected with the cabinet 100 structurally, and the tub 200 is structurally connected with the cabinet 100 and independently supported by a suspension (not shown).

That is, since a gasket except the suspension is not provided between the tub 200 and the cabinet 100 unlike the washing machine 1 of the related art, the suspension is only supported, whereby delivery of the vibration of the tub 200 to the cabinet 100 may be reduced remarkably.

The tub door 230 includes a second outer frame 231 forming an outer side of the tub door 230, a ring shaped second inner frame 235 forming an inner circumference of the tub door 230, provided with a hollow portion, a ring shaped ring sealer 241 interposed between the second outer frame 231 and the second inner frame 235, for sealing between the second insertion hole 210 of the tub 200 and the tub door 230, and a light transmissive frame 239 inserted into the hollow portion of the second inner frame 235 to identify the inside of the tub 200 or the drum 400.

A protrusion 236 to which the second hinge unit 242 is coupled is formed at one side of the second inner frame 235, and a recess 237 to which upper and lower rotational portions 244 and 246 and a rotational spring 248 are inserted is formed in the protrusion 236. The upper and lower rotational portions 244 and 246 and the rotational spring 248 will be described later.

Also, a fixed bracket 238 for rotatably fixing the upper and lower rotational portions 244 and 246 and the rotational spring 248 fixed to the recess 237 is provided at an inner side of the second inner frame 235. Meanwhile, a tub door hook 249 inserted to the tub door lock 260, which will be described later, maintaining a locking state of the tub door 230 is provided at the other side of the second inner frame 235.

A protrusion 234 for covering the protrusion 236 formed in the second inner frame 235 is formed at one side of the second outer frame 231, and a pressurizing roller 250 for opening the cabinet door 160 by pushing the cabinet door 160 in contact with the roller pressurizing surface 165 of the cabinet door 160 located outside the tub door 230 when the tub door 230 is rotated in an opening direction is provided at a predetermined portion of the outer side of the second outer frame 231.

Figure 12:
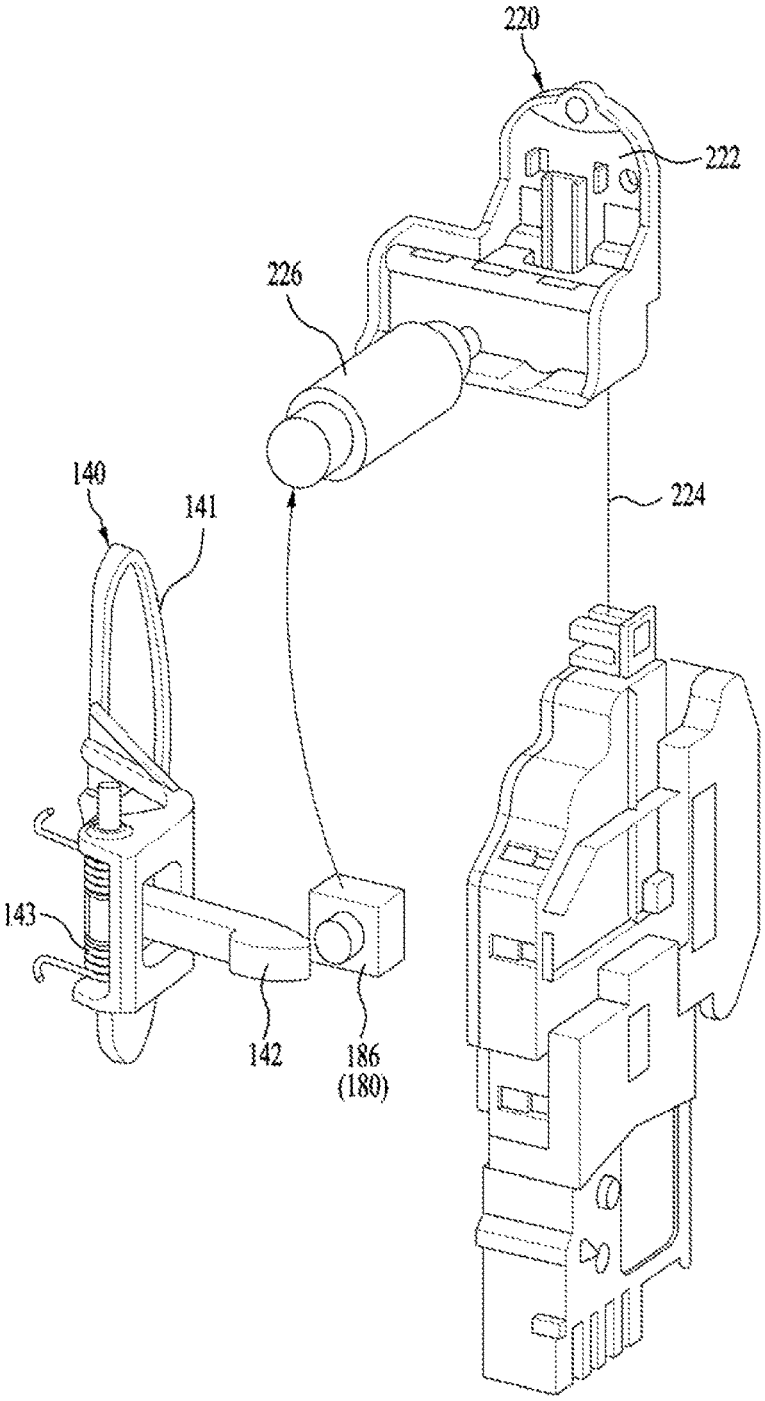
FIG. 12 is a conceptual view illustrating an unlocking unit of a washing machine according to the present invention.

The pressurizing roller 250 is intended to prevent the cabinet door 160 or the tub door 230 from being damaged by friction between the cabinet door 160 and the tub door 230 when the tub door 230 is opened by the rotational spring 248 of the second hinge unit 242, and, as shown in FIG. 12, includes a fixed unit 251 fixed to a roller insertion unit 232 provided in the second outer frame 231 of the tub door 230, a movable unit 253 movably fixed to the fixed unit 251 at a predetermined spacing with respect to the fixed unit 251, and a roller 256 having a rotational shaft parallel with the rotational shafts of the cabinet door 160 and the tub door 230 is provided inside the movable unit 253.

A plurality of protrusions 252 for restricting a moving distance of the movable unit 253 are formed at each corner of the fixed unit 251, and the movable unit 253 is held in the protrusions 252 of the fixed unit 251 to be prevented from being detached from the fixed unit 251. Also, a spring 255 for allowing the movable unit 253 to be spaced apart from the fixed unit 251 at a predetermined elastic force is provided between the fixed unit 251 and the movable unit 253. Meanwhile, a roller groove 254 to which the roller 256 is rotatably fixed is formed inside the movable unit 253.

When the tub door 230 is opened by the pressurizing roller 250, the pressurizing roller 250 opens the cabinet door by pushing the cabinet door 160 in an opening direction in contact with the roller pressurizing surface 165 formed in the first inner frame 168 of the cabinet door 160.

It has been described that the aforementioned pressurizing roller 250 is located outside the tub door 230 and the pressurizing surface 165 is formed inside the cabinet door 160 as an example. However, the pressurizing roller 250 may be located inside the cabinet door 160 and the pressurizing surface 165 may be formed outside the tub door 230.

The second hinge unit 242 is fixed to the second hinge coupling unit 214 formed at one side of the rim portion 212 of the second insertion hole 210 to rotatably support the tub door 230 and at the same time provide a predetermined elastic force in a direction that the tub door 230 always opens the second insertion hole 210.

The second hinge unit 242 includes a hinge body 243 fixed to the second hinge coupling unit 214, upper and lower rotational portions 244 and 246 protruded and extended from upper and lower portions of the hinge body 243, upper and lower rotational shafts 245 and 247 provided at ends of the upper and lower rotational portions 244 and 246 and rotatably fixed to the recess 237 of the second inner frame 235 of the tub door 230, and a rotational spring 248 having the same rotational shaft as the upper and lower rotational shafts 245 and 247 and providing an elastic force to the tub door 230 in an opening direction of the tub door 230 with respect to the second insertion hole 210.

It is preferable that the rotational portions 244 and 246 provided in the second hinge unit 242 are formed to be smaller than the distance between the upper and lower rotational portions 171 and 173 of the first hinge unit 168.

That is, the first hinge unit 168 and the second hinge unit 242 rotatably support the cabinet door 160 and the tub door 230 in a state that they have their respective rotational shafts different from each other. In this respect, to prevent the rotational shafts of the first and second hinge units 168 and 242 from interfering with each other, centers of the rotational shafts are spaced apart from each other and at the same time detached from each other, whereby interference of the first and second hinge units 168 and 242 is avoided.

The tub door lock coupling unit 216 formed at the other side of the second insertion hole 210 of the tub 200 includes the tub door lock 260 locked by insertion of the tub door hook 249 of the tub door 230, and the tub door lock releaser 220 provided to adjoin the second insertion hole 210, releasing the locking state of the tub door lock 260 by interworking with the unlocking unit 140.

The tub door lock releaser 220 is intended to release the locking state of the tub door lock 260 by means of an unlocking signal generated by a release switch 186 of the unlocking unit 140, and includes a solenoid 226 operated in accordance with the signal generated by the release switch 186, a rotational portion 222 rotated in accordance with the operation of the solenoid 226, and a tensile cable 224 for delivering a rotational force of the rotational portion 222 to the tub door lock 260 in accordance with rotation of the rotational portion 222.

The tub door lock 260 is intended to control the locking state of the tub door 230 provided in the second insertion hole 210, and includes a hook holder 181 fixed to the tub door lock coupling unit 216 to be adjacent to the second insertion hole, and a cable interlocking unit 261 connected to the tensile cable 224 of the tub door lock releaser 220 to be adjacent to the hook holder 181.

In the aforementioned description, although the tub door lock releaser 220 and the tub door lock 230 have been described respectively, the solenoid 226 of the tub door lock releaser 220 may directly be provided in the tub door lock 260 to release the tub door lock 260 by using the signal of the release switch 186 of the cabinet door lock 180.

The operation of the washing machine according to one embodiment of the present invention will be described in detail with reference to the accompanying drawings. The respective elements described hereinafter should be understood with reference to the aforementioned description and drawings. Meanwhile, the main subject of the present invention lies in locking and unlocking of the cabinet door 160 and the tub door 230. Therefore, description of general operation (for example, washing stroke, rinsing stroke, dehydrating stroke, etc.) of the washing machine 1 will be omitted.

Prior to description of opening operation of the cabinet door 160 and the tub door 230, closing states of the cabinet door 160 and the tub door 230 will be described. The cabinet door 160 maintains a locking state as its cabinet door hook 175 is fixed to the cabinet door lock 180, and the tub door 230 maintains a locking state as its tub door hook 249 is fixed to the tub door lock 260.

Figure 13:
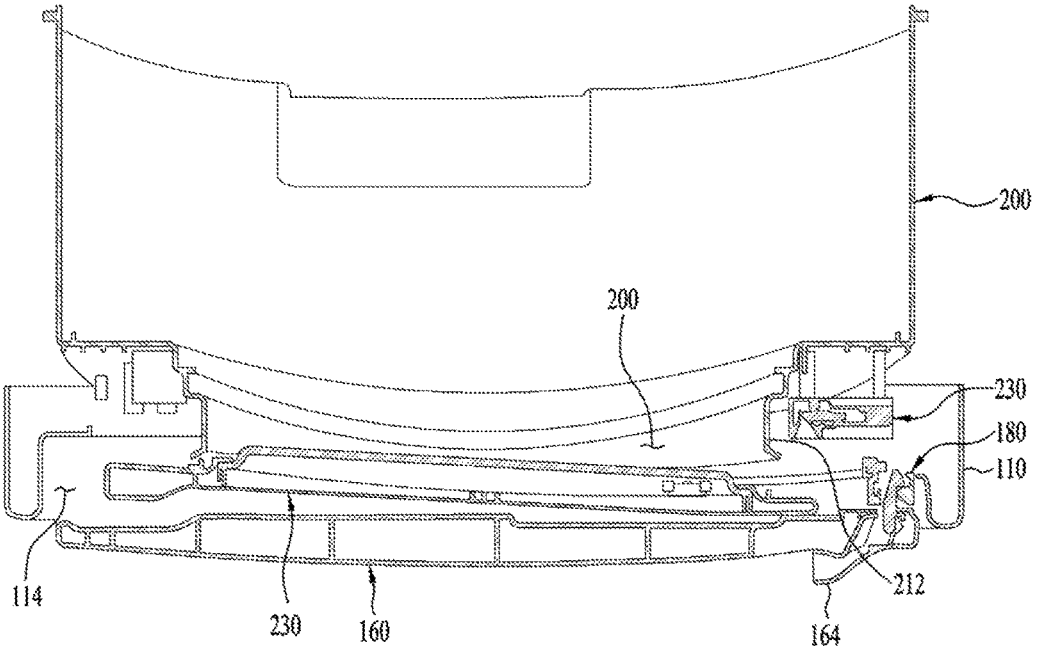
FIGS. 13 and 14 are plane and cross-sectional views illustrating a locking unit of a washing machine according to the present invention.
Figure 14:
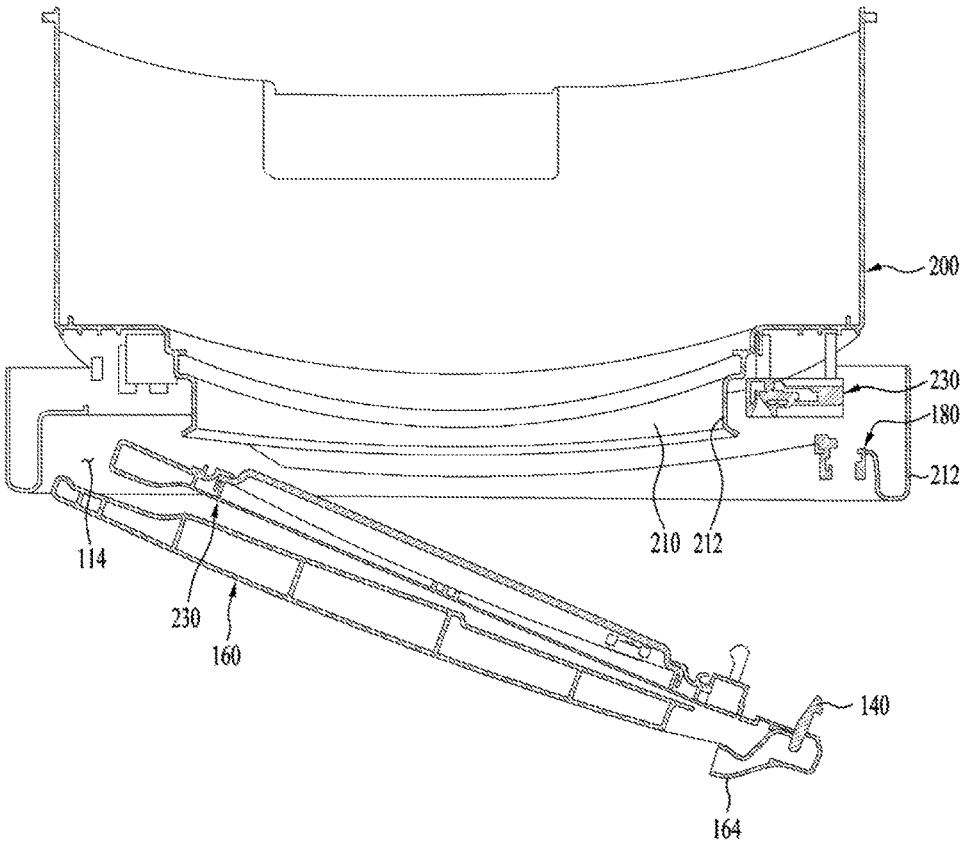

First of all, an opening operation of the cabinet door 160 and the tub door 230 will be described with reference to the accompanying drawings. FIG. 12 is a conceptual view illustrating an unlocking unit of a washing machine according to the present invention, and FIGS. 13 and 14 are plane and cross-sectional views illustrating a locking unit of a washing machine according to the present invention.

To open the cabinet door 160, a user grips the grip portion 164 formed in the cabinet door 160 of the front cabinet 110 and then pressurizes the grip portion 164 in an opening direction of the cabinet door 160. In this case, a release lever 141 of the unlocking unit 140 provided inside the grip portion 164 is rotated, whereby the locking state of the cabinet door hook 142 is released, and the release switch 186 of the cabinet door lock 180 senses the locking release of the cabinet door hook 142.

The solenoid 226 of the cabinet door lock releaser 150 is operated in accordance with sensing of the release switch 186 to operate the rotational portion 222, and the cable interlocking unit 261 of the tub door lock 260, which is connected to the tensile cable 224 of the rotational portion, is operated in accordance with rotation of the rotational portion 222, whereby the locking state of the tub door hook 249 fixed to the hook holder 181 of the tub door lock 260 is released, and at the same time the locking states of the cabinet door 160 and the tub door 230 are released.

As the locking states of the cabinet door 160 and the tub door 230 are released, the tub door 230 is rotated in its opening direction by the rotational spring 248 provided in the second hinge unit 242 of the tub door 230, and the pressurizing roller 250 provided in the second outer frame 231 of the tub door 230 pressurizes the roller pressurizing surface 165 formed in the first inner frame 168 of the cabinet door 160 and at the same time pressurizes the cabinet door 160 in an opening direction of the cabinet door 160, whereby the cabinet door 160 is opened simultaneously with the tub door 230 by the tub door 230.

Figure 15:
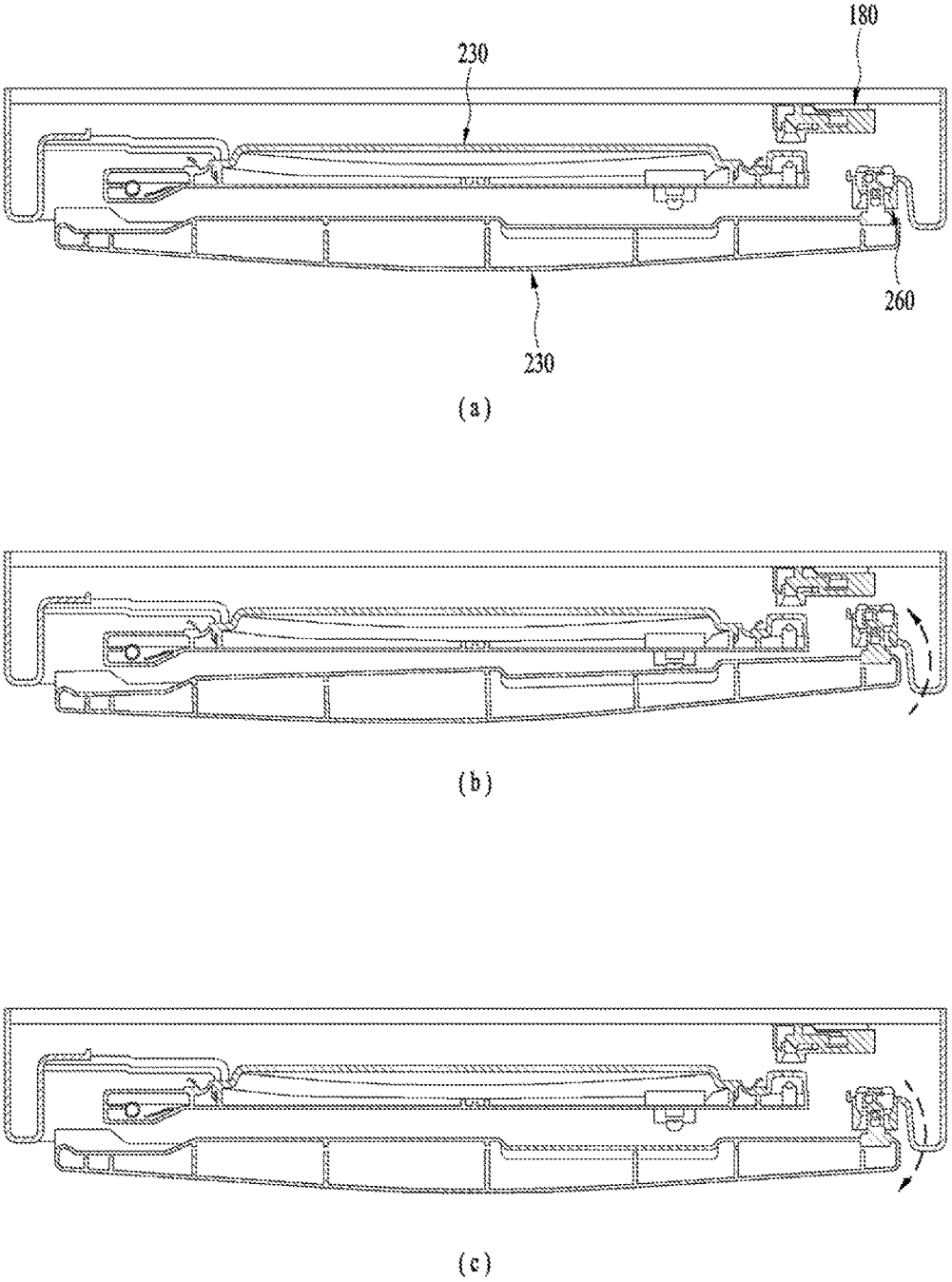
FIG. 15 is a plane and cross-sectional view sequentially illustrating a locking state of a washing machine according to the present invention.

Hereinafter, a closing operation of the cabinet door 160 and the tub door 230 will be described with reference to the accompanying drawing. FIG. 15 are plane and cross-sectional views sequentially illustrating a locking state of a washing machine according to the present invention.

As shown, when the cabinet door 160 and the tub door 230 are closed, as a user rotates the cabinet door 160 in a closing direction, the roller pressurizing surface 165 formed in the first inner frame 168 of the cabinet door 160 adjoins the pressurizing roller 250 provided in the second outer frame 231 of the tub door 231, and the cabinet door 160 and the tub door 230 are rotated in their closing direction while overcoming an elastic force of the rotational spring 248 provided in the second hinge unit 242 of the tub door 230.

As the cabinet door 160 and the tub door 230 are rotated, the cabinet door hook 175 of the cabinet door 160 is inserted into the cabinet door lock 180, and at the same time the tub door hook 249 of the tub door 230 is inserted into the tub door lock 260 (see FIG. 15(*a*)).

As the cabinet door 160 is closed by the user, when the cabinet door hook 175 of the cabinet door 160 is inserted into the cabinet door lock 180, since the hook insertion unit 183 into which the cabinet door hook 175 is inserted is elastically supported by the spring, the cabinet door lock 180 is pressurized by rotation of the cabinet door 160, whereby the cabinet door hook 175 is fully fixed to the cabinet door lock, and the tub door is further moved as much as a moving distance of the hook insertion unit of the cabinet door lock and then fixed to the tub door lock (see FIG. 15(*b*)).

A pressurizing force of the user, which is applied to the cabinet door, is removed, and the hook insertion unit 183 of the cabinet door lock 180 returns to its original position by an elastic force of the spring for supporting the hook insertion unit 183. The cabinet door 160 fixed to the cabinet door lock 180 by the returning force of the hook insertion unit returns to a position spaced apart from the tub door 230, whereby closing of the cabinet door and the tub door is completed (see FIG. 15(*c*)).

As described above, when the cabinet door 160 and the tub door 230 according to the washing machine according to the present invention are closed, they are maintained to be spaced apart from each other, whereby vibration of the tub is prevented from being directly delivered to the cabinet during the washing operation.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

The invention claimed is:

1. A washing machine comprising a cabinet comprising a front cabinet part having a first insertion hole defined at a front side of the front cabinet part;

a tub provided in the cabinet, the tub having a second insertion hole aligned with the first insertion hole;

a cabinet door rotatably attached to the cabinet and configured to rotate about a first axis to open or close the first insertion hole;

a cabinet door lock provided on the front cabinet part, the cabinet door lock configured to maintain a locked state of the cabinet door;

a tub door rotatably attached to the tub and configured to rotate about a second axis different from the first axis and parallel to the first axis to open or close the second insertion hole;

a tub door lock provided at a front side of the tub, the tub door lock configured to maintain a locked state of the tub door;

an unlocking unit provided in the cabinet door, the unlocking unit configured to unlock the cabinet door and control unlocking of the tub door;

a hinge unit for elastically supporting the tub door in an opening direction of the second insertion hole;

a tub door lock releaser provided in the cabinet, the tub door lock releaser configured to unlock the tub door based on an operation of the unlocking unit; and an anti-friction member provided between an outer side of the tub door and an inner side of the cabinet door, the anti-friction member configured to reduce friction between the tub door and the cabinet door.

2. The washing machine according to claim 1, wherein the unlocking unit includes:

a release lever provided in a grip portion of the cabinet door; and a release switch for sensing opening of the cabinet door in accordance with an operation of the release lever, wherein the tub door lock releaser is further configured to release the tub door lock in accordance with sensing of the release switch.

3. The washing machine according to claim 2, wherein the cabinet door is fixed to the hinge unit to have a rotational shaft spaced apart from the hinge unit.

4. The washing machine according to claim 3, wherein the cabinet door is opened by interworking with the tub door as the tub door is opened.

5. The washing machine according to claim 4, wherein the anti-friction member pressurizes the cabinet door to open the first insertion hole as the tub door is opened.

6. The washing machine according to claim 5, wherein the tub door is closed by interworking with the cabinet door as the cabinet door is closed.

7. The washing machine according to claim 6, wherein the cabinet door pressurizes the anti-friction member to close the first insertion hole as the cabinet door is closed.

8. The washing machine according to claim 7, wherein the anti-friction member includes a pressurizing roller provided at the outer side of the tub door, the pressurizing roller configured to apply pressure to the inner side of the cabinet door.

9. The washing machine according to claim 1, wherein the tub door lock switches the tub door to the locked state as the cabinet door is rotated in a closing direction.

10. The washing machine according to claim 9, wherein the tub door lock switches the tub door to the locked state after the cabinet door is switched to the locked state by the cabinet door lock.

11. The washing machine according to claim 10, wherein the cabinet door lock moves the cabinet door to be spaced apart from the tub door after the tub door is switched to the locking state.

* * * * *